United States Patent [19]

Porter et al.

[11] Patent Number: 4,733,807

[45] Date of Patent: Mar. 29, 1988

[54] CONTAINER FOR MEDICINALS

[76] Inventors: Robert E. Porter, 700 Church Rd.; Richard Reube, 1001 Orvilla Rd., both of Hatfield, Pa. 19440

[21] Appl. No.: 388,270

[22] Filed: Jun. 14, 1982

[51] Int. Cl.[4] ..... B65D 85/56

[52] U.S. Cl. ..... 224/202; 206/37; 206/38; 206/540; 215/100 A; 215/12.1

[58] Field of Search ..... 128/272; 206/528-540, 206/37, 38; 215/12 A, 12 R, 13 R, 100 A, DIG. 3; 220/410, 411, 94 R, 293; 224/201, 202; 248/317; 604/403

[56] References Cited

U.S. PATENT DOCUMENTS

| | | | |
|---|---|---|---|
| 1,141,929 | 6/1915 | Bruebach | 215/12 R |
| 1,567,021 | 12/1925 | Detlefsen et al. | 206/19 |
| 1,753,611 | 4/1930 | Lower | 215/12 R |
| 2,035,384 | 3/1936 | Hinchcliff | 215/12 R |
| 2,781,960 | 2/1957 | Dick | 215/100 A |
| 2,812,874 | 11/1957 | Casalino | 215/13 R |
| 3,332,563 | 7/1967 | Reshan | 215/13 R |
| 3,405,829 | 10/1968 | Siravo | 215/13 R |
| 3,567,085 | 3/1971 | Flores | 224/202 |
| 3,572,560 | 3/1971 | Dolph | 224/202 |
| 3,621,994 | 11/1971 | Brown | 220/410 |
| 3,828,991 | 8/1974 | Moore | 224/202 |
| 3,912,137 | 10/1975 | Tomatsuri | 224/202 |
| 3,977,638 | 8/1976 | Woodard | 224/202 |
| 3,980,117 | 9/1976 | Trombley | 215/13 R |
| 4,129,228 | 12/1978 | Stoneback | 220/293 |
| 4,228,908 | 10/1980 | Tweeton | 215/12 A |
| 4,278,167 | 7/1981 | Van Rossem | 215/12 R |

FOREIGN PATENT DOCUMENTS

| | | | |
|---|---|---|---|
| 0645628 | 10/1928 | France | 220/94 R |

*Primary Examiner*—Jimmy G. Foster

*Attorney, Agent, or Firm*—Joseph W. Molasky & Assocs.

[57] ABSTRACT

A medicinal container is constructed of a holder adapted to receive and hold a bottle containing the medicinal tablets. The open top portion of the bottle is threadedly engaged with a cap for providing an air-tight seal. A chain is secured to an ear portion of the holder and is adapted to extend around the neck of the user.

10 Claims, 4 Drawing Figures

FIG. 1
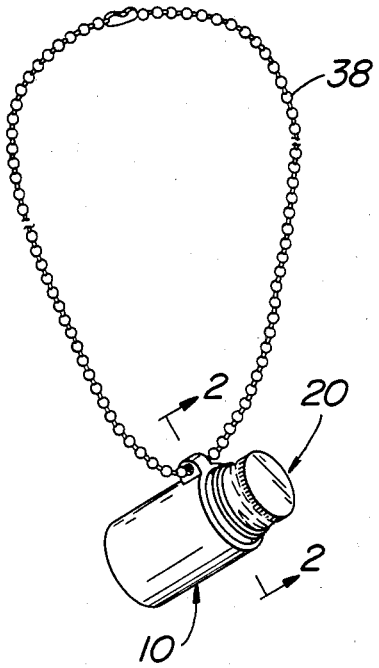
FIG. 2
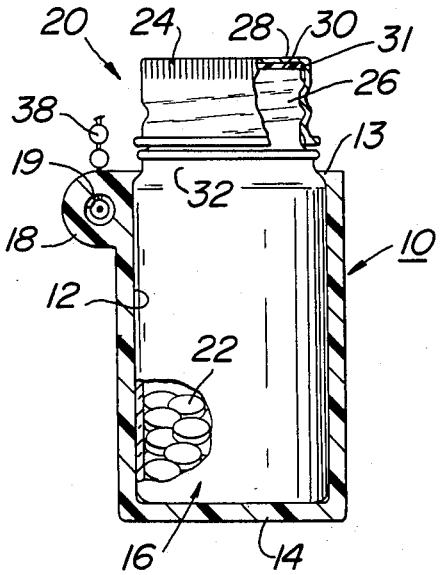
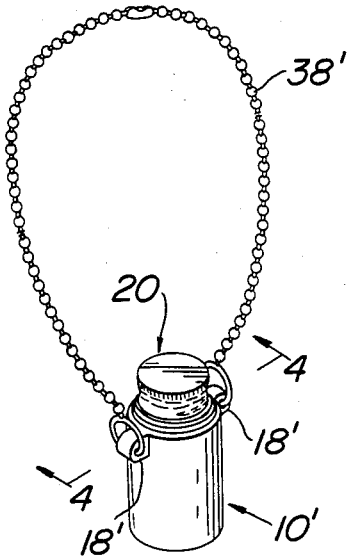
FIG. 3
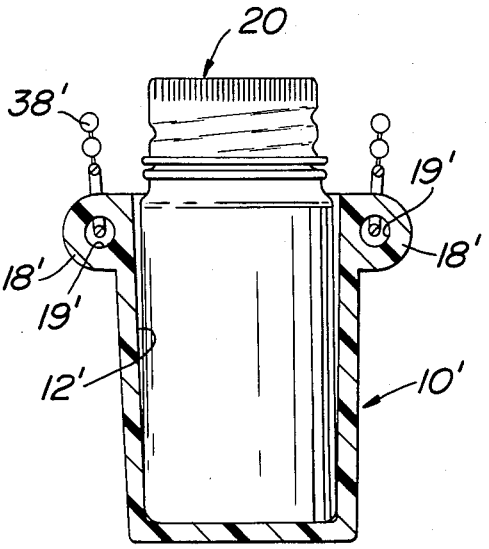
FIG. 4

CONTAINER FOR MEDICINALS

BACKGROUND AND SUMMARY OF THE INVENTION

This invention relates to containers for medicinals which provide for ready access including such times as emergency conditions or the like. The medicinal container of the invention is particularly suitable for medicinals such as nitroglycerin tablets used by heart patients to prevent a possible oncoming heart attack.

Briefly stated, the medicinal container of the invention comprises a cup-shaped holder adapted for receiving and holding a bottle containing the medicinal tablets. The open top portion of the bottle is threadedly engaged with a cap for providing an air-tight seal. A cord or chain is secured to an ear portion of the holder and is adapted to extend around the neck of the user to support the holder and bottle near the chest area of the user for ready access.

The medicinal container in accordance with the invention has many advantages.

One advantage is that the container insures that the medicinal is available to the user under all circumstances, particularly under an emergency situation. By being supported around the neck of the user, the medicinal containing bottle is always within easy reach of the user. Also, the threaded cap can be easily removed from the bottle to provide access to the medicinal therein. Furthermore, medical personnel will be aware of the location of the medicinal in the case of an emergency and the possibility of the medicinal being separated from the patient is minimized.

Another advantage is that the bottle, which is made of glass, provides for maximum stability of the medicinal. The USP specifies that certain medicinals, such as nitroglycerin tablets, are to be dispensed in a glass container, and the medicinal container of the invention conforms with this specification. Moreover, glass containers maintain stability of the medicinal longer than any other material. Further, the bottle will retain its original label to provide important information, such as drug dosage, etc.

Another feature of the medicinal container of the invention is that it is constructed to minimize the possibility of breakage. The holder, which is made of a flexible plastic, provides a protective covering for the medicinal containing bottle to reduce the chance of breakage of the bottle. Moreover, in the event that the glass bottle should be broken, the plastic holder serves to minimize the possibility of injury to the user from the broken glass. Furthermore, by reason of the use of a chain to support the container around the neck of the user, the possibility of receiving a blow that would break the container is minimized.

A further feature of the medicinal container of the invention is that the holder provides a convenient area for the placing of appropriate instructions and advertising that would be readily visible in the case of an emergency to any one assisting the patient.

Another advantage of the medicinal container of the invention is that it permits the use of disposable medicinal containing bottles. For example, in the case of nitroglycerin tablets, which are available in bottles of 25 tablets, when all the tablets are consumed by the user, the user would simply insert a new bottle into the holder. By this mode of use, the container does not wear out and is simply replaced when the tablets are used up.

Moreover, the screw-type top is easy for the user to open and close and maintains an air tight seal.

Another advantage of the medicinal container of the invention is that maximum cleanliness is achieved. In use, a new container is used with each 25 tablets and the new tablets are completely clean. This avoids the necessity of handling tablets by transferring them between containers and maintains cleanliness. Moreover, by using a new bottle each time a bottle is used up, there is avoided the possibility of mixing up incorrect tablets which could occur anytime the tablets are transferred from one container to another.

Another feature of the invention is that the holder provides an area on which a medical alert symbol could be provided. This would alert those assisting the heart patient to the condition of an unconscious patient. Moreover, the container would more likely stay with the patient in case he was involved in an accident by reason of it being secured around the neck of the patient.

Another feature of the medicinal container of the invention is its durability. This is achieved by the use of a durable plastic material for the holder and because the chain could be replaced easily in the event that it is broken.

Another feature of the invention is that it is inexpensive to manufacture and could be sold at a low price.

There is no product in use today that achieves all of the above-described advantages of the medicinal container of the invention. One presently available product comprises a chain-mounted aluminum cartridge having a plug-like top which is provided with an o-ring seal which contacts the internal wall of the container. However, this product is expensive to manufacture and has a limited life because the o-ring wears out after a period of use. Also, the plug-like top is difficult to remove because of the frictional contact between the o-ring and the cartridge and would be particularly difficult to remove in an emergency situation.

BRIEF DESCRIPTION OF THE DRAWINGS

FIG. 1 is a perspective view of a first embodiment of the invention.

FIG. 2 is a sectional view taken on line 2—2 of FIG. 1.

FIG. 3 is a perspective view of a second embodiment of the invention.

FIG. 4 is a sectional view taken on line 4—4 of FIG. 3.

DETAILED DESCRIPTION OF THE PREFERRED EMBODIMENTS

The medicinal container of the invention shown in FIGS. 1 and 2 comprises a generally cup-shaped holder 10 having a hollow cylindrical construction. Holder 10 has a cylindrical inner wall 12 and a bottom 14 defining a cylindrical internal chamber 16 adapted to receive and hold a small cylindrical bottle 20 of the type used for containing medicinal tablets, indicated at 22. Holder 10 is made of a suitable flexible plastic (synthetic resin) such as, for example, polyethylene or polypropylene.

Bottle 20 is of the type used to contain a small number of medicinal tablets such as, for example, the bottles used by Parke-Davis to contain twenty-five nitroglycerin tablets used by heart patients to prevent an oncoming heart attack. This bottle is approximately $1\frac{1}{2}$ inches in height and $\frac{5}{8}$ of an inch in diameter and is made of glass as is required by the USP.

Bottle 20 has a cap 24 adapted to threadedly engage threads on the top portion 26 of bottle 20 as shown in FIG. 2. In use, cap 24 is threaded onto the top end 26 until the base 28 thereof presses a gasket 31 into contact with the upper end 30 of bottle 20 to provide an air-tight seal. This sealed construction protects the tablets 22 contained in the bottle 20 against deterioration by exposure to the atmosphere.

Means are provided for frictionally holding bottle 20 within holder 10 in the normally supported position shown in FIGS. 1 and 2. To this end, internal wall 12 of holder 10 is provided with a small inwardly projecting lip 13 at the open end of holder 10. Lip 13 projects into a circumferentially extending recess 32 in the bottle just below the threaded portion thereof. By this construction, the bottle 20 is frictionally restrained from moving out of the contained position shown in FIGS. 1 and 2 by the cooperation between lip 13 with the portions of the bottle 20 defining recess 32. The user can purposely insert and remove a bottle 20 from holder 10 as desired by simply grasping the holder 10 in one hand and the cap 24 of bottle 20 in the other hand and either separating them or moving them together as desired.

Lip 13 extends inwardly from wall 12 only a few thousandth of an inch, the lip 13 being shown in exaggerated form in FIG. 2 for illustrative purposes.

Means are provided for supporting the holder 10 and the bottle 20 contained therein around the neck of the user so as to support the bottle 20 at a location generally near the chest of the user. To this end, holder 10 is provided with an ear 18 near the open end thereof. Ear 18 is provided with a hole 19 adapted to slidably receive a chain 38. By reason of this construction, the holder 10 would normally be supported in the position as shown in FIG. 1 extending at an angle to the horizontal with the chain 38 around the neck of the user. This type of support orients the holder 10 and bottle 20 in an ideal position for handling by the user.

The medicinal container of the invention shown in Figures 3 and 4 is essentially the same as that shown in FIGS. 1 and 2, the only essential differences being the means on the holder for frictionally supporting the bottle 20 and the engagement means between the chain and the holder. As shown in FIG. 3, a holder 10' is provided with a pair of ears 18' positioned at the open end of the holder 10' at diametrically opposed locations. Ears 18' are provided with holes 19' adapted to be engaged by the ends of a chain 38' as is shown in FIG. 3. By this arrangement, the holder 10' can be supported in a vertically extending position on the user.

As shown in FIG. 4, the internal wall 12' of holder 10' is tapered inwardly from the open end thereof so as to frictionally engage the outer wall of the bottle 20. This frictional engagement is used to retain the bottle 20 in the position within holder 10' shown in FIGS. 3 and 4. It is noted that the taper shown in FIG. 4 is exaggerated for illustrative purposes and this taper is very slight.

We claim:

1. A container for medicinals such as pills or the like comprising:

a holder defining an internal chamber and having an open top, a bottle for containing the medicinal and having an open top, a cap threadedly engageable with the top portion of the bottle for tightly closing and opening the top of said bottle, said internal chamber of said holder being adapted to receive the bottle therein with the cap projecting beyond the open end of the holder, said holder having means on the internal wall thereof for engaging the outer surface of said bottle at a location below said cap so as to hold said bottle in said internal chamber with a frictional force that can be readily overcome by a manual pulling force applied by the user to both said bottle and said holder to cause a separating movement thereof whereby said bottle can be easily removed from said holder for access to the medicinal contained therein, and a chain means attached to said holder and adapted to extend around the neck of the user to support the holder and bottle near the chest area of the user.

2. A medicinal container according to claim 1 wherein said bottle engaging means of said holder comprises a lip extending inwardly from the internal wall thereof near the top end thereof for frictionally engaging a portion of said bottle to frictionally hold the same within said chamber.

3. A medicinal container according to claim 2 wherein said holder has an ear near the open end thereof, said chain being slidably received in a hole in said ear.

4. A medicinal container according to claim 2 wherein said holder is provided with a pair of ears at diametrically opposed locations at the upper end thereof, said ears being provided with holes adapted to be engaged with the ends of said chain.

5. A medicinal container according to claim 4 wherein said holder is made of a cup-shaped one-piece plastic construction which also forms said bottle engaging means and said ears.

6. A medicinal container according to claim 2 wherein said holder is made of a one-piece plastic construction which also forms said bottle engaging means.

7. A medicinal container according to claim 1 wherein said holder has a tapered internal wall providing said means for frictionally engaging the bottle.

8. A medicinal container according to claim 1 wherein said holder has an ear near the open end thereof, said chain being slidably received in a hole in said ear.

9. A medicinal container according to claim 1 wherein said holder is provided with a pair of ears at diametrically opposed locations at the upper end thereof, said ears being provided with holes adapted to be engaged with the ends of said chain.

10. A medicinal container according to claim 1 wherein said holder is made of a cup-shaped one-piece plastic construction which also forms said bottle engaging means.

* * * * *